US009738964B2

(12) United States Patent
Bremer et al.

(10) Patent No.: US 9,738,964 B2
(45) Date of Patent: Aug. 22, 2017

(54) METHOD FOR THE NITRO CARBURIZATION OF A DEEP-DRAWN PART OR A STAMPED-BENT PART MADE OF AUSTENITIC STAINLESS STEEL

(71) Applicant: Hubert Stüken GmbH & Co. KG, Rinteln (DE)

(72) Inventors: Cord-Hinrich Bremer, Verden (DE); Rolf Lange, Langenhagen (DE)

(73) Assignee: Hubert Stücken GmbH & Co. KG, Rinteln (DE)

( * ) Notice: Subject to any disclaimer, the term of this patent is extended or adjusted under 35 U.S.C. 154(b) by 356 days.

(21) Appl. No.: 14/557,592

(22) Filed: Dec. 2, 2014

(65) Prior Publication Data

US 2015/0159262 A1 Jun. 11, 2015

(30) Foreign Application Priority Data

Dec. 6, 2013 (EP) ..... 13196075

(51) Int. Cl.

| | |
|---|---|
| ***C23C 8/32*** | (2006.01) |
| ***C23C 8/02*** | (2006.01) |
| ***C23C 8/34*** | (2006.01) |
| ***C23C 8/10*** | (2006.01) |
| ***C23C 8/80*** | (2006.01) |

(52) U.S. Cl.
CPC ..... *C23C 8/32* (2013.01); *C23C 8/02* (2013.01); *C23C 8/10* (2013.01); *C23C 8/34* (2013.01); *C23C 8/80* (2013.01)

(58) Field of Classification Search
CPC ..... C23C 8/32
See application file for complete search history.

(56) References Cited

U.S. PATENT DOCUMENTS

| | | | |
|---|---|---|---|
| 5,102,476 A | 4/1992 | Wahl | |
| 6,461,448 B1 | 10/2002 | Williams et al. | |
| 2011/0162758 A1 | 7/2011 | Watanabe et al. | |
| 2012/0111454 A1 | 5/2012 | Moyer | |
| 2014/0254736 A1* | 9/2014 | Hertz | C21D 6/004 376/241 |

FOREIGN PATENT DOCUMENTS

| | | | |
|---|---|---|---|
| DE | 102009056875 | A1 | 6/2011 |
| EP | 0479409 | A2 | 4/1992 |
| EP | 0588458 | A1 | 3/1994 |
| EP | 0678589 | A1 | 10/1995 |
| EP | 1193413 | A1 | 4/2002 |
| EP | 1553204 | A1 | 7/2005 |
| EP | 2497842 | A1 | 9/2012 |
| EP | 2627795 | A1 | 8/2013 |

OTHER PUBLICATIONS

Effect of $C_2H_2$ content of performance of AISI304 austenitic stainless steel after ionic carbonitriding process, Zhang Yi-chen, et al, Vacuum, vol. 45, No. 3, pp. 28-30, May 2008.

* cited by examiner

*Primary Examiner* — Jessee Roe

(74) *Attorney, Agent, or Firm* — Harness, Dickey & Pierce, P.L.C.

(57) ABSTRACT

A method for the nitro-carburization of a deep-drawn article or a stamped-bent article made of austenitic rustproof stainless steel includes inserting the article into an oven in a first process step and heating the article to a first temperature, wherein an oxygen containing standard atmosphere that is present in the oven is replaced by a first gas mixture, and in which the article is heated up to a second temperature in a second process step, wherein the first gas mixture is replaced by a second gas mixture, and in which the article is maintained on the second temperature in a third process step, wherein the article is treated with the second gas mixture, and in which the article is cooled down to a third temperature in a fourth process step, wherein the second gas mixture is replaced by a third gas mixture.

11 Claims, No Drawings

METHOD FOR THE NITRO CARBURIZATION OF A DEEP-DRAWN PART OR A STAMPED-BENT PART MADE OF AUSTENITIC STAINLESS STEEL

CROSS-REFERENCE TO RELATED APPLICATIONS

This application claims the benefit and priority of European patent application No. EP13196075.9, filed Dec. 6, 2013. The entire disclosure of the above application is incorporated herein by reference.

FIELD

The invention relates to a method for the nitro carburization of a deep-drawn part or a stamped-bent part made of austenitic stainless steel and having a small wall thickness, which is usual for such parts, in at least some areas.

BACKGROUND

The nitro carburization is a method for the surface hardening of metals, in which the metal to be hardened is enriched with carbon and nitrogen in the surface zone thereof. It has been established in the state of the art for a long time, for which reason no particular reference has to be made to prior publications here.

Usual small wall thicknesses of deep-drawn parts and stamped-bent parts in the sense of the invention are beneath 2000 μm. Such stainless steel parts are manufactured from very thin sheet metals by means of tensile compression reshaping or stamping-bending and sometimes take very filigree structures. Depending on the used method, parts having a varying or constant wall thickness can be produced, whereby these ones then entirely comprise a wall thickness of less than 2000 μm or they have such a wall thickness in at least some areas.

These filigree items are used in the most different fields of technique, such as for example as bearing covers in gearboxes, valve seats in ABS systems or as sample carriers for hazardous substances in high-precision measurements and are subject to extreme mechanical, thermal and chemical stress. The demand for corrosion resistant materials comprising a high hardness is therefore accordingly high.

The quality of such hardened items, in particular of such parts which have a high length diameter ratio (aspect ratio), has however been poor so far with respect to the mechanical resistance as well as the corrosion resistance. If established methods for surface hardening known from the state of the art are used for items having a very thin wall thickness, no industrially reproducible surface layers which meet the quality requirements can be produced.

Electron microscopic and metallographic examinations of cross sections of nitro-carburized deep-drawn articles have shown that surface layers which have been produced in this manner do not form a circumferentially closed structure. These surface layers are rather strongly fissured and comprise a plurality of channels which penetrate the surface layer and in which the environment and the unhardened core area of the deep-drawn article get into direct contact. The surface area produced in this way also comprises numerous defect sites and coarse grained particles. Due to this heterogeneous configuration, both the hardness of the surface layer and the corrosion properties thereof are subjected to such high fluctuations that an industrial application is only possible to a highly limited extend.

The reason for these results has over all to be seen in the partially extreme treatment conditions of the established methods.

Thus, DE 44 42 382 C1 shows a method for the nitro carburization of a rustproof steel article, in which the said steel article is treated in a molten alkaline bath. Such an aggressive kind of treatment causes filigree items in the sense of the invention to get partially considerable corrosion damages because of the thin wall thickness, leading to a highly inhomogeneous surface layer. Furthermore it has been proved that liquid treatments of filigree items lead to unsatisfying results because of an incomplete surface wetting.

In this connection EP 0 588 458 discloses a method for the nitration of an austenitic metal. Herein, a fluorine-based gas is applied to the metal. Fluorine-based gases are highly corrosive due to their reactivity and as a result they act aggressively on the surface of the metal. While the thus caused surface removal is even desired for articles having a high wall thickness and a corresponding high amount of material, this surface removal cannot be compensated in thin-walled deep-drawn and stamped-bent items and leads to the irreversible destruction of the surface of the article. Furthermore, the gases used there are highly toxic, highly corrosive and comprise properties that are highly endangering the environment and thus they place enormous requirements on the reactor to be used, the storage and the operational safety.

SUMMARY

It is therefore the object of the invention to provide an effective method for the nitro carburization of thin-walled deep-drawn or stamped-bent stainless steel articles.

For achieving this aim, an invention comprising the features according to the present disclosure is proposed. Further advantages and features will become apparent from the sub-claims.

The invention advantageously proposes a method comprising mild conditions which are adapted to the particularities of thin-walled deep-drawn and stamped-bent articles.

DETAILED DESCRIPTION

According to the invention, the article is inserted into an oven for carrying out the method. It has been found that oxygen and water residues especially interfere with the surface hardening. For excluding these disruptive factors, the article is heated up to a temperature which is above the boiling temperature of water. Herein, a temperature comprised between 110° C. and 140° C. is preferred and 120° C. is most preferred.

Furthermore, according to the invention, the oxygen containing atmosphere in the oven will be replaced by a first gas mixture. Therefore, the oven advantageously comprises gas inlets and gas outlets.

According to a preferred manner of carrying out the process, it can be provided to flood the oven with an inert gas before introducing the first gas mixture. Herein, the oxygen displacement will be advantageously accelerated and a possible hazard potential resulting from the contact of the standard atmosphere containing oxygen with the first gas mixture will be reduced. Known chemically unreactive gases such as in particular nitrogen or argon will be preferably used as inert gas.

Non-rusting stainless steels inter alia comprise chrome as an alloying element. Due to the contact with atmospheric oxygen, a passivating and corrosion resistant chromium (III) oxide layer is formed on the material surface.

In methods for surface hardening, in particular the nitro carburization, it is of enormous importance to remove or depassivate this passivating chromium oxide layer, in order to enable a homogenous diffusion of the carbon and the nitrogen into the surface zone of the stainless steel. If this is not assured due to lacking depassivation, the diffusion will be impeded in areas having an intact chromium oxide layer and the consequence will be an inhomogeneous hardness distribution in the resulting surface layer. Furthermore, a lacking depassivation in the areas having an intact chromium oxide layer leads to the formation of defect sites in the surface area. These defect sites ultimately lead to an undesired reduced wear resistance and adversely affect the corrosion resistance of the steel.

According to a preferred feature of the invention, the first gas mixture therefore has reducing characteristics, in order to avoid a further oxidation of the chrome. Furthermore, this gas mixture already initiates the depassivation of the surface. According to another preferred feature of the invention, the first gas mixture is at least composed of a hydrogen containing gas and a nitrogen containing gas and especially preferred are $H_2$ and $N_2$. It has been found that this gas mixture, in particular in connection with the mild temperature of the first process step, has an especially mild and advantageous effect on the chromium oxide layer without having a detrimental effect on the morphology of the surface of the filigree articles.

According to a preferred feature of the invention, the oxygen concentration will be measured continuously or at intervals by means of a sensor. Herein, a control unit connected to the sensor compares the actual value continuously or at intervals to a freely selectable set point and in case of an identity between the actual value and the set point, the control unit enables the oven to carry out the second process step. The method according to the invention is advantageously highly simplified hereby and minimizes possible sources of error for the user in this manner.

According to the invention, a second process step is provided, in which the deep-drawn or stamped-bent article is heated up to the target temperature, the second temperature, for the surface hardening. The second temperature is preferably selected such that this one is clearly beneath the recrystallization temperature of highly cold formed iron alloys (680° C.). Herein, a possible modification of the morphology of the surface is effectively prevented, whereby the formation of a homogenous surface layer is promoted. The second temperature is preferably comprised between 450° C. and 550° C. and is most preferably 500° C. The heating up phase especially serves to the gentle and complete depassivation of the chromium oxide layer.

It is advantageous to select the heat-up rate, at least in certain temperature ranges, as low as possible, in order to assure a uniform depassivation. In this connection, the applicant has discovered that the quality of the resulting surface layer of thin-walled deep-drawn parts significantly suffers from a high heat-up rate. In a certain temperature range, the heat-up rate is preferably comprised between 0.5 and 1° C./min, more preferably between 0.5 and 0.7° C./min and most preferably 0.5° C./min. The temperature range, in which this low heat-up rate is selected, is preferably comprised between 420° C. and 550° C., more preferably between 450° C. and 500° C. and most preferably between 480° C. and 500° C.

According to a feature of the invention, the first gas mixture will be replaced by a second gas mixture in the second process step. Herein, it has been found that a mild depassivation of the thin-walled deep-drawn parts during the heat-up phase to the second temperature will be preferably realized by a gas mixture that is at least composed of a hydrogen containing gas, a nitrogen containing gas as well as a carbon containing gas. In particular in connection with the low heat-up rate, an especially slow and thus mild and well controllable depassivation of the chromium oxide layer can be preferably achieved.

According to a preferred feature of the invention, the article will be treated with additives which selectively or entirely dissolve the passive layer. These additives especially refer to salt compounds and/or organic substances and acidifiers which are applied to the good or in the oven in solid or liquid form. Herein, the application takes preferably place before the article is inserted into the oven or during the second process step. For this purpose, solids and/or liquids are used which form acid reaction products in connection with the reaction gases, which reaction products would result in a pH value of <7 if they were introduced into water. Herein, the application of the substances directly onto or into the article surface has proved to be especially advantageous. Hereby, local depassivation processes which early initiate and promote a uniform depassivation will be initiated already at low temperatures.

As carbon containing component, preferably carbon oxides, saturated, unsaturated, aliphatic, cyclic, heterocyclic and/or aromatic hydrocarbons can be added to the second gas mixture. Herein, the use of carbon oxides, such as especially carbon monoxide, is highly preferred.

As nitrogen containing component, preferably elementary nitrogen, ammonia, amines, amides, imides, nitriles and/or nitrogen oxides can be added to the second gas mixture. The use of ammonia is most preferably preferred.

Herein, it has been furthermore found that the use of elementary hydrogen as a constituent of the second gas mixture leads to the formation of especially homogenous surface layers.

According to a preferred feature of the invention, the temperature will be measured continuously or at intervals by means of a sensor. Herein, the control unit connected to the sensor compares the actual value continuously or at intervals to a freely selectable set point for the second temperature and in case of an identity between the actual value and the set point, the control unit enables the oven to carry out the third process step. The method according to the invention is advantageously highly simplified hereby and minimizes possible sources of error for the user in this manner.

According to the invention, a third process step is provided, in which the article is constantly kept on the second temperature. In this connection, the third process step serves to the nitro carburization of the thin-walled article and leads to the formation of a hardened surface layer due to the carburization and the nitridation of the surface area of the steel article. It has been found that the second temperature advantageously enables a gentle formation of the hardened surface layer. The diffusion of the carbon and the nitrogen into the surface area of the deep-drawn part takes place slowly at these temperatures, can thus be easily controlled and causes a homogenous surface layer to form. The process according to the invention in particular promotes the formation of a surface layer which is composed of a phase which is rich in carbon and closer to the core and an outer phase which is rich in nitrogen. A too high temperature has to be avoided in any case, since due to the high diffusion speed and the high kinetic energy of the involved molecules, uneven layers and carbide and/or nitride particles will be formed.

According to the invention, the second gas mixture will be used for the nitro carburization of the deep-drawn article. In connection with the mild temperature, the second gas mixture provokes an especially mild and controlled formation of the surface layer according to the invention composed of a phase rich in carbon and a phase rich in nitrogen.

It has been found that in particular the use of carbon monoxide in this method leads to an especially homogenous phase rich in carbon.

Furthermore it has been found that the use of ammonia promotes the formation of an especially homogenous phase rich in nitrogen.

According to a preferred feature of the invention, the individual concentrations of the gas components will be measured continuously or at intervals by means of respective sensors. Herein, the control unit connected to the sensors compares the respective actual values continuously or at intervals to freely selectable set points for the respective concentration of the gas component and compensates deviations within a fault tolerance continuously or at intervals. The process control is advantageously simplified hereby and allows providing constant process conditions, which is of decisive importance for the formation of a homogenous surface layer rich in carbon.

Herein, the layer thickness of the surface layer rich in carbon can be set by means of the duration of gassing. Advantageously, a period of time comprised between 2 and 20 hours is required for generating a surface layer having a thickness of 5-35 μm.

According to a preferred feature of the invention, the control unit, which comprises a corresponding device for measuring the time, will enable the oven to carry out the fourth process step after a freely selectable nitro carburization time has elapsed. The method according to the invention is advantageously highly simplified hereby and minimizes possible sources of error for the user in this manner.

According to the invention, a fourth process step is provided, in which the deep-drawn part is cooled down to a third temperature. Herein, it is preferably provided to cool down the deep-drawn part to a temperature comprised between 50° C. and 80° C. and most preferably to 60° C.

Herein it has been found that the selection of the atmosphere in which the cooling down process takes place is of decisive importance for the formation of a homogenous surface layer. It is therefore provided according to the invention to replace the second gas mixture by a third gas mixture. The selection of a slightly reducing gas mixture is especially considered to be advantageous. According to a preferred embodiment of the invention, the third gas mixture is composed of at least a hydrogen containing gas and a nitrogen containing gas. Herein, it is especially preferred that the third gas mixture is composed of $H_2$ and $N_2$. In order to assure a weak reduction potential, the composition of the third gas mixture advantageously contains 5% to 25% $H_2$ and 75% to 95% $N_2$, more preferred 5% to 10% $H_2$ and 90% to 95% $N_2$ and especially preferred 5% $H_2$ and 95% $N_2$. It has been shown that the cooling down according to the invention of the thin-walled deep drawn part effectively prevents an escape of the carbon and the nitrogen from the hardened surface layer and promotes the inclusion of both components in dissolved form.

The invention furthermore relates to a nitro-carburized deep-drawn article made of austenitic rustproof stainless steel having a small wall thickness in at least some areas which is usual for deep-drawn articles.

For the first time it has become possible by means of the method according to the invention to harden a deep-drawn article having a small wall thickness in an industrially reproducible manner and with excellent quality.

The deep-drawn article according to the invention comprises a soft or, depending on the cold forming, more work-hardened elastic core and a hard surface layer.

According to a feature essential for the invention, the surface layer is free of defect sites and/or particles, completely closed over the circumference and comprises an essentially flat surface.

As a result, the thin-walled deep-drawn article according to the invention comprises mechanical properties of a hitherto unattained quality.

The corrosion and the abrasion resistance of the deep-drawn article according to the invention are thus better than those of the starting product. This is enabled by the structure of the surface layer according to the invention. The surface layer is composed of an outer phase rich in nitrogen and a phase rich in carbon which is located between the core and the phase rich in nitrogen. Herein, the phase rich in carbon comprises a hardness comprised between 700 and 1000 HV0.025 and a layer thickness comprised between 2.5 and 15 μm. The phase rich in nitrogen however comprises a hardness comprised between 1000 and 1400 HV0.025 and a layer thickness comprised between 2.5 and 20 μm.

In this manner, a hardness gradient from the soft core to the harder phase rich in carbon to the still harder phase rich in nitrogen is advantageously formed. Hereby, the material is advantageously flexible in the core area thereof and hardened in the surface area thereof. Thanks to a two-phase surface layer having a different hardness, the surface layer also comprises an increased flexibility and simultaneously an enormous hardness.

What is claimed is:

1. A method for the nitro-carburization of a deep-drawn article or a stamped-bent article made of austenitic stainless steel, comprising:

inserting the article into an oven in a first process step and heating the article to a first temperature, wherein an oxygen containing standard atmosphere that is present in the oven is replaced by a first gas mixture, and in which the article is heated up to a second temperature in a second process step, wherein the first gas mixture is replaced by a second gas mixture, and in which the article is maintained on the second temperature in a third process step, wherein the article is treated with the second gas mixture, and in which the article is cooled down to a third temperature in a fourth process step, wherein the second gas mixture is replaced by a third gas mixture.

2. A method according to claim 1, wherein the first temperature is comprised between 100° C. and 140° C.

3. A method according to claim 1, further including measuring a residual oxygen content by means of a sensor during the first process step and that the second process step will be automatically initiated if a freely selectable residual oxygen value is reached.

4. A method according to claim 1, wherein the second temperature is comprised between 450° C. and 550° C.

5. A method according to claim 1, wherein the third process step will be automatically initiated if the second temperature is reached.

6. A method according to claim 1, wherein the first gas mixture is composed of at least a hydrogen containing gas and a nitrogen containing gas.

7. A method according to claim 1, wherein the article is treated with at least one depassivating salt compound.

8. A method according to claim 1, wherein the second gas mixture is composed of at least a hydrogen containing gas, a nitrogen containing gas and a carbon containing gas.

9. A method according to claim 1, wherein the fourth process step will be automatically initiated after a freely selectable duration of treatment has elapsed.

10. A method according to claim 1, wherein the third temperature is comprised between 50° C. and 80° C.

11. A method according to claim 1, wherein the third gas mixture is composed of at least a hydrogen containing gas and a nitrogen containing gas.

* * * * *